US005251752A

United States Patent [19]

Purohit

[11] Patent Number: 5,251,752

[45] Date of Patent: Oct. 12, 1993

[54] WET BLADE RAZOR STORAGE AND PRESERVATIVE APPARATUS

[75] Inventor: Ahnal A. Purohit, Darien, Ill.

[73] Assignee: Anshal, Inc., Darien, Ill.

[21] Appl. No.: 684,661

[22] Filed: Apr. 12, 1991

Related U.S. Application Data

[63] Continuation-in-part of Ser. No. 495,471, Mar. 19, 1990, Pat. No. 5,007,533.

[51] Int. Cl.[5] ..... A46B 11/04; A46B 17/04

[52] U.S. Cl. ..... 206/352; 401/183; 401/129

[58] Field of Search ..... 401/129, 183, 269; 206/208, 352

[56] References Cited

U.S. PATENT DOCUMENTS

| | | | |
|---|---|---|---|
| 564,483 | 7/1896 | Gregory | 401/269 |
| 1,534,521 | 4/1925 | Halbeck | 401/269 |
| 1,912,627 | 6/1933 | Dyer | 206/208 |
| 3,759,594 | 9/1973 | Cobb | 206/208 X |
| 3,912,665 | 10/1975 | Spitzer et al. | 15/244.4 X |
| 3,929,986 | 12/1975 | Bouillon et al. | 424/47 X |
| 4,002,558 | 1/1977 | Feldman | 208/188 |
| 4,225,253 | 9/1980 | Fraleigh | 401/183 X |
| 4,235,873 | 11/1980 | Packman | 424/70 X |
| 4,629,753 | 12/1986 | Quinn | 427/388.4 X |
| 4,710,048 | 12/1987 | Vartoughian | 401/129 X |
| 4,875,791 | 10/1989 | Hassan | 401/269 |
| 4,911,919 | 3/1990 | Patel et al. | 427/70 |
| 4,940,349 | 7/1990 | Jansen van Rensburg | 401/269 X |
| 5,007,533 | 4/1991 | Purohit | 206/208 |

*Primary Examiner*—Steven N. Meyers
*Assistant Examiner*—Jacob K. Ackun, Jr.
*Attorney, Agent, or Firm*—Charles F. Lind

[57] ABSTRACT

The disclosed invention uses an open-top vessel for supporting a water rinsed razor and its blade, the vessel being filled with mineral oil to a level above the blade. Different mechanisms are used for holding the razor and for moving the submerged razor and mineral oil relative to one another. One mechanism comprises mechanically gripping the razor and moving it through the mineral oil contained within the vessel. Another mechanism comprises moving the mineral oil, by pumping it or vibrating it, relative the razor. The disclosed invention also uses a portable storage vessel having a brush bristle outlet for the mineral oil, and brushing the mineral oil onto the blade manually. In using all such mechanisms, the razor blade is effectively coated with the mineral oil to isolated it from the atmospheric air and thereby protect it from dulling caused by corrosion.

2 Claims, 4 Drawing Sheets

WET BLADE RAZOR STORAGE AND PRESERVATIVE APPARATUS

This is a Continuation-in-part Application from my copending application Ser. No. 07/495,471 filed Mar. 19, 1990 for WET BLADE RAZOR STORAGE APPARATUS issues as U.S. Pat. No. 5,007,533 on Apr. 16, 1991

BACKGROUND OF THE INVENTION

Wet blade razors, or the type used with a wet lather or shaving cream, generally is presumed to have a useful life of only one or at most several shaves. Thereafter, the shaver feels uneven pulling of the blade against the skin or sees and feels that the shave is not close. In fact, the blade does lose its cutting edge very fast.

Many factors are believed to contribute to the short useful life of a wet razor, including: (1) physical wear on the cutting edge caused by dragging it across the skin and actually cutting the hairs; and (2) exposure of the cutting edge to the lather or shaving cream and to the water, during shaving, and possible chemical oxidation of the blade that occurs then.

The inventor herein has determined that the above-listed factors actually contribute an insignificant percentage, toward the short useful life of a wet razor. The real culprit is chemical oxidation that occurs after the shaving has been completed, the blade and razor has been rinsed clean with water, and the razor is set aside and stored until the next time for shaving. During this period, exposure of the razor blade to the atmospheric air promotes chemical oxidation of the blade's cutting edge, that dulls it many times faster than during shaving itself.

SUMMARY OF THE INVENTION

This invention relates to apparatus to allow storage and/or preservation and storage of a wet blade razor, between the times it is actually to be used.

Basic objects of the present invention are to provide apparatus suited to preserve and/or preserve and store the razor during its nonuse, so as to retain blade sharpness and to yield an extended useful razor life.

To achieve these and other objects, the present invention may provide a vessel filled with mineral oil, and means for holding the razor relative to the vessel with its blade exposed to or in said mineral oil. Means may further be provided to move the razor blade and the mineral oil relative to one another, to apply a complete and through oil coating on the blade. This may be accomplished by moving the razor blade when submerged under the oil contained within the vessel, by moving the oil within the vessel over the razor blade, or by moving the oil over the razor blade while held outside of the vessel.

BRIEF DESCRIPTION OF THE DRAWINGS

Further objects, advantages and features of the present invention will appear from the following disclosure and description, including as a part thereof the accompanying drawings, in which.

DETAILED DESCRIPTION OF ILLUSTRATED EMBODIMENTS

Figure 1:
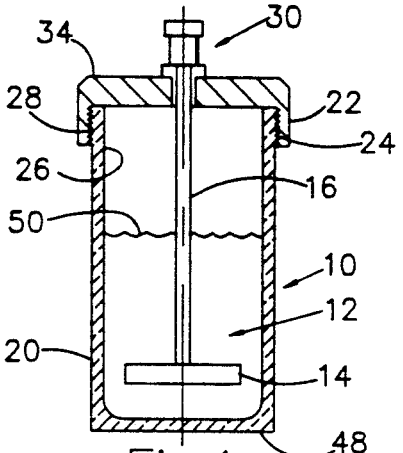
FIG. 1 is an elevational sectional view of a first embodiment of the invention to be disclosed herein.

FIG. 1 shows apparatus 10 for preserving and storing, during nonuse, a wet razor 12 having a blade end 14 and a handle 16 cantilevered away from the blade end. Any popular wet razor can be benefitted when used with the apparatus, so that the razor may have a single or multiple blade construction, a single or double edge blade, or a fixed or adjustable blade exposure or angle mounting feature.

The apparatus 10 has an open-top liquid-tight vessel 20, and a closure means or cap 22 for covering the vessel top. The connection 24 between the vessel 20 and cap 22 is illustrated as mating conventional screw-type threads formed on the telescoping axially extended vessel and cap side walls 26 and 28; although alternative constructions may be used, including quick-connect mating pin and groove lock means (not shown) which can be locked or unlocked with less than one-quarter turn of the cap relative to the vessel.

Figure 2:
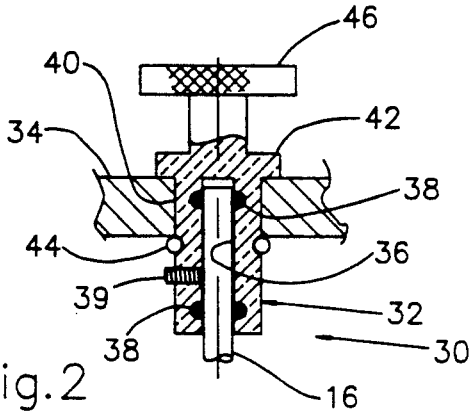
FIG. 2 is an enlarged fragmentary section showing additional details of a mounting for the razor and the rotational aspect of the mounting.

Razor holding means 30 is formed in the apparatus 10, shown in FIG. 2 as a plug member 32 carried on the cross wall 34 of the closure cap 22. The plug member 32 will have a closed end bore 36 sufficiently large to receive the free end of the razor handle 16; and a retaining lock means in the form of spaced O-rings 38 contained in shallow annular recesses in the plug member adjacent the bore, fit snuggly around the razor handle 16 so as to releasably secure it as so positioned. A set screw 39 threaded into a tap in the plug member 32 can be used also, or alternatively, being tightened against the razor handle 16.

The plug member 32 moreover has a cylindrical exterior fitted in a cylindrical opening 40 in the cap cross wall 34, so as to be rotatable around an axis substantially normal to the cap wall. The plug member 32 may have an upper flange 42 suited to rest on the top surface of the cap cross wall, and an O-ring 44 contained in an annular recess in the outside surface of the plug member adjacent the underside of the cap cross wall, so as to axially lock the plug member relative to the cap cross wall.

An enlarged cylindrical handle 46 is part of or is keyed to the plug member 32, suited to be gripped between the shaver's thumb and fingers for rapidly rotating the plug member 32 and/or oscillating it back and forth. The razor holding means 30 in the plug member 32 will be effective to key the razor handle nonrotatably relative to the plug member, such as by shaping the bore 36 in a rectangular shape to key a correspondingly shaped razor handle 16 and/or by the tightness of the gripping O-rings 38 and/or by the tightness of the set screw 39. Thus, the razor 12 rotates as the razor holding means 30 is rotated.

The invention provides the use, with the apparatus so far disclosed, of mineral oil stored in the vessel 20 to a level such as indicated by line 50, above the blade end 14 so as to have the cutting edge (not shown) of the razor blade submerged in said mineral oil. Moreover, a hygroscopic material, such as pellets of calcium chloride ($CaCl_2$) may be contained in the mineral oil, on the bottom wall 48 of the vessel in the region spaced below the blade end 14. A mineral oil having a light to medium viscosity might be preferred.

For using the invention, the shaver would remove the cap 22 from the vessel 20 in order to remove the razor 12 from the razor holding means 30, as needed during shaving. Any mineral oil on the razor can be rinsed off, if desired, although the presence of the oil does seem to ease any feeling of blade drag while shaving. After shaving, the shaver would water rinse the razor clean, shake it dry, position it in the razor holding means 30, and position the held razor in the vessel 20 by closing the cap 22 on the vessel.

As the razor 12 is so held in the vessel 20, the blade end 14 is submerged in the mineral oil, close to but spaced above any hygroscopic material contained also in the vessel, The shaver would then rapidly spin the positioned razor 12 by gripping the handle 46 between the thumb and fingers, and/or would rapidly oscillate the razor. This action would centrifically throw off excess water from the razor, and would force the mineral oil into encompassing relationship of all exposed parts of the razor and particularly at and over the cutting edge of the blade.

Any water spun off of the razor will be absorbed by the hygroscopic material, or would in time sink to the bottom of the mineral oil as it is more dense than the mineral oil. The mineral oil, in this encompassing relationship of and over the blade edge, serves to coat the cutting edge of the blade and to preserve its sharpness. The inventor has observed that razors stored in this manner between shaves, can be used for several months of daily shaves with the feel and comfort of a new razor.

Figure 3:
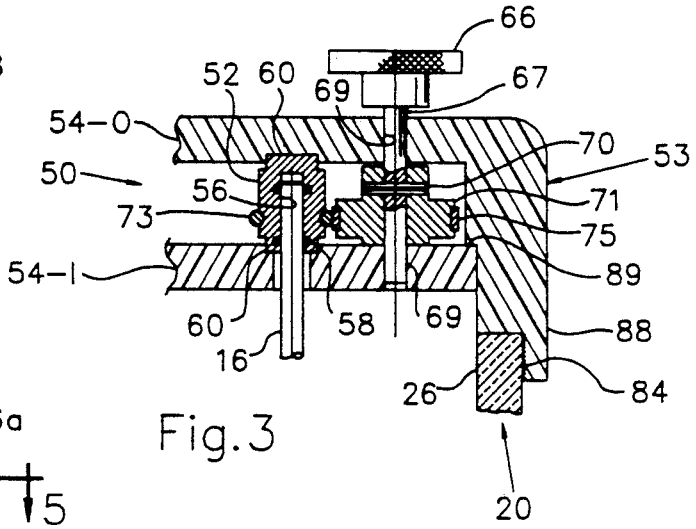
FIG. 3 is an enlarged fragmentary section similar to FIG. 2, except showing an alternative embodiment of razor mounting.

FIG. 3 illustrates a modified razor holding means 50, formed as a plug member 52 carried between cross walls 54-O and 54-I of the closure cap 53. The plug member 52 will have a closed end bore 56 sufficiently large to receive the free end of the razor handle 16; and a retaining lock means in the form of O-rings 58 contained in shallow annular recesses in the plug member adjacent the bore, fit snuggly around the razor handle 16 so as to releasably secure it as so positioned.

The plug member 52 moreover has opposing cylindrical exterior bearings fitted in cylindrical recesses 60 in the cap cross walls 54-O and 54-I, so as to be rotatable around an axis substantially normal to the cross walls.

An enlarged cylindrical handle 66 is keyed to shaft 67 extended through beearing openings 69 in the cap cross walls 54-O and 54-I, and a drive member 71 is keyed to this shaft by pin 70 to lie between the cap cross walls. Friction bands 73 and 75 are fitted in appropriate recesses in the plug and drive members 52 and 71, and these bands have generally cylindrical exterior shapes and engage one another so as to key the plug and drive members 52 and 71 together rotatably. The drive member friction band 75 is larger than the plug member band 73, to provide a motion multiplier between the rotations of the handle 66 and the plug member 52.

The closure cap 53 will likewise be secured as by connection 84 between the telescoping cylindrical side walls 88 and 26 of the vessel 20, to close the open top of the vessel and hold the razor 16 secured thereto with its blade end (not shown) suspended inside the vessel. The inner cap cross walls 54-I may be press-fit within the cap side wall 26, against shoulder 89 thereon.

The primary advantage of this embodiment of closure cap 53 is the motion multiplier drive between the drive and plug members 71 and 52 respectively offers the possibility of spinning the razor, as submerged in the mineral oil, at a more rapid rate, tending then to even more completely encompass the razor within the mineral oil.

Figure 4:
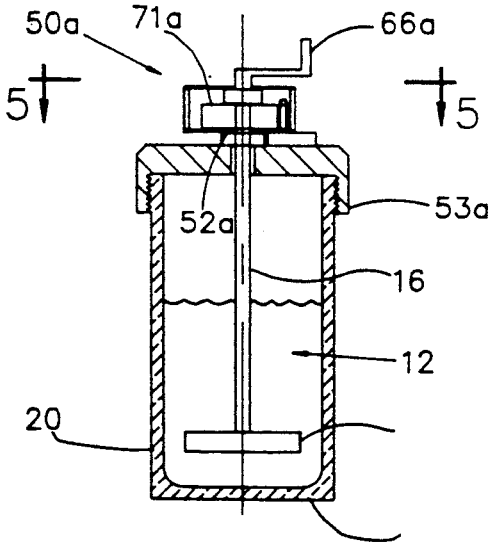
FIG. 4 is an elevational sectional view of another embodiment of the invention to be disclosed herein.
Figure 5:
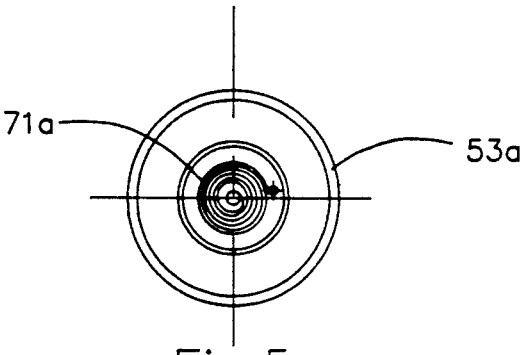
FIG. 5 is a top sectional view, as seen generally from line 5—5 in FIG. 4.

FIGS. 4 and 5 illustrates another modified razor holding means 50*a*; provided certain details of construction have been eliminated, as such can be formed as already illustrated in FIGS. 1-3. The razor holding means 50*a* has a plug member 52*a* rotatably supported relative to the cap 53*a*, for holding the razor 12 and its handle 16 as noted above within the vessel 20. A coil spring 71*a* is connected between the plug member 52*a* and cap 53*a*, and a handle 66*a* keyed to the plug member 50*a* allows for winding the spring. An escapement mechanism of conventional design (not shown) may be provided for holding the spring wound and for releasing it. Upon releasing the wound spring 71*a*, the plug member 52*a* will be rotated rapidly to move the held razor 12 within the contained mineral oil, to provide mechanically forced razor exposure to the mineral oil. This advantageously coats the razor blade for preserving it during nonuse storage of the razor for extending its effective shaving life.

Figure 6:
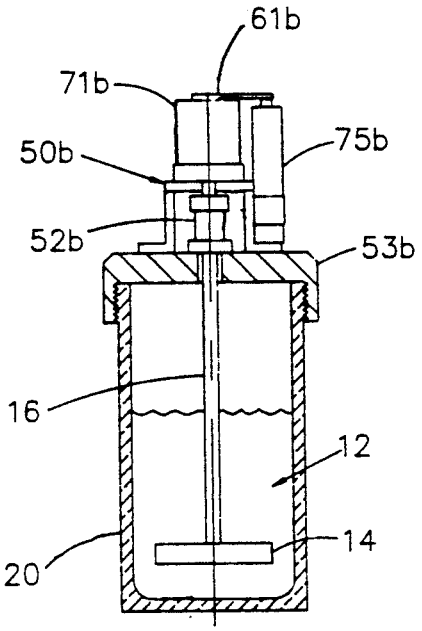
FIGS. 6–13 are elevational sectional views of alternative embodiments of the invention to be disclosed herein.

FIG. 6 shows modified razor holding means 50*b*, comprising portable electrical power means for moving the razor relative to the mineral oil contained in the vessel 20. A battery-powered motor 71*b* is connected between the razor-holding plug member 52*b* and cap 53*b*, and a battery 75*b* carried also on the cap is connected via on-off switch 61*b* to the motor. Actuation of the motor 71*b* powers the plug member 52*b*, to mechanically move the razor 12 via the connected handle 16 rapidly within the mineral oil for increasing mineral oil build-up over the entire razor blade end 14.

Figure 7:
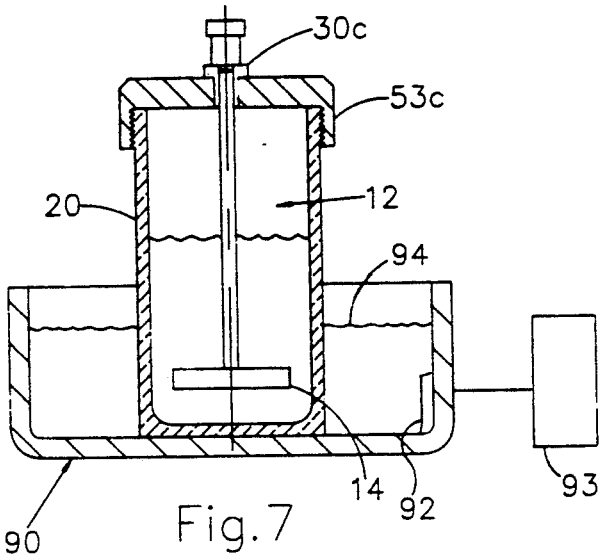
Figure 9:
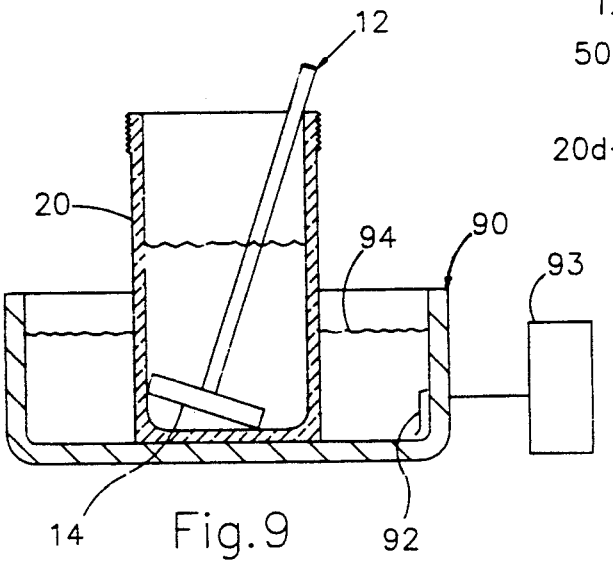
Figure 8:
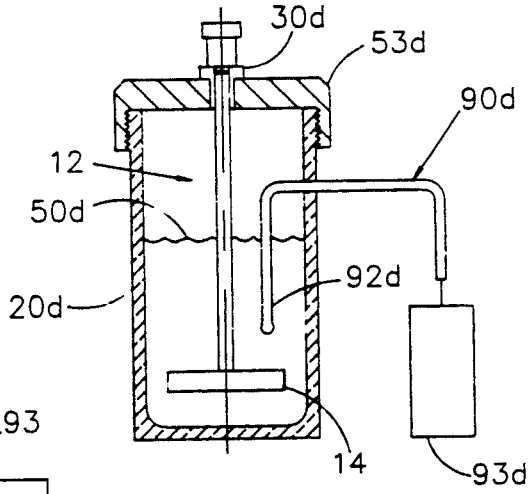

FIGS. 7, 8 and 9 show alternative power mechanisms for moving the razor 12 and the mineral oil contained in the vessel 20 relative to one another, to provide that the cutting blade head end 14 held submerged in the the mineral oil is completely coated by the mineral oil for increased blade perservation and extended razor service life. Each of these mechanisms utilizes the principles of ultrasonic vibrations.

In FIGS. 7 and 8, a cup-shaped ultrasonic vibrator 90 having a piezoelectric mechanism 92 formed therein and powered by an electrical source 93 is provided, and an oil containing vessel 20 is supported in each vibrator 90. Water is also contained in each vibrator 90 to a level 94, to couple the piezoelectric mechanism 92 with the vessel and the oil contained in vessel 20, and via the oil with the submerged cutting blade head end 14. In FIG. 7, a cap 53*c* closes the vessel 20, and a razor holding means 30*c* on the cap holds the razor 12 relative thereto substantially centered within the vessel, as in the previous disclosures. In FIG. 8, the vessel 20 has no cap illustrated and is open at its top, and the razor 12 is merely rested in the vessel with the submerged cutting blade head end 14 against the vessel bottom wall 48.

In FIG. 9, a modified cupshaped vessel 20*d* is provided having a rod-shaped ultrasonic piezoelectric mechanism 92*d* formed therein as part of the vessel and powered by an electrical source 93*d*. Mineral oil is contained in the vessel 20*d* to the level 50*d*, to submerge the ultrasonic piezoelectric mechanism 92*d*. Cap 53*d* closes the vessel 20*d*, and razor holding means 30*d* on the cap holds the razor 12 relative thereto substantially centered within the vessel.

Activation of the ultrasonic vibrator 90 or 90*d* rapidly moves the cutting blade head end 14 of the razor and the mineral oil relative to one another, for establishing a mineral oil layer uniformily over the blade. The capped embodiments of FIGS. 7 and 9 more positivly hold and centrally locate the razor, and consequently may provide for more unforn transmission of the ultrasonic vibrations against the blade's cutting edge. Also, the capped embodiments allows for razor storage, while maintaining the mineral oil covered and clean, without the ultrasonic vibrator operating. The uncapped embodiment of FIG. 8 is easy and fast to use, involving merely: water rinsing the used razor and shaking it manually to remove excess water, submerging the cutting blade head end 14 of the razor in the mineral oil, operating the ultrasonic vibrator 90 for a short duration and then removing the razor for storage in air until the next use, and capping the vessel for maintaining the mineral oil covered and clean. It would be possible also to use the apparatus of FIG. 9 without the cap 53*d*, with the razor positioned as in FIG. 8, should one desire this manner of operation.

Also, while the vibrators illustrated are of the ultrasonic piezoelectric type, alternative vibrators could be used while yet achieving effective coating the razor with the mineral oil, to eliminate exposure of the blade edge to the atmospheric air.

Figure 10:
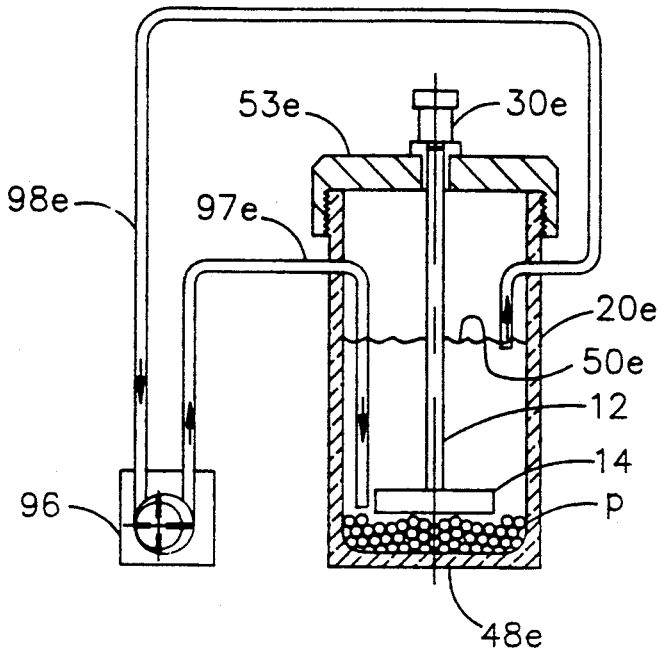
Figure 11:
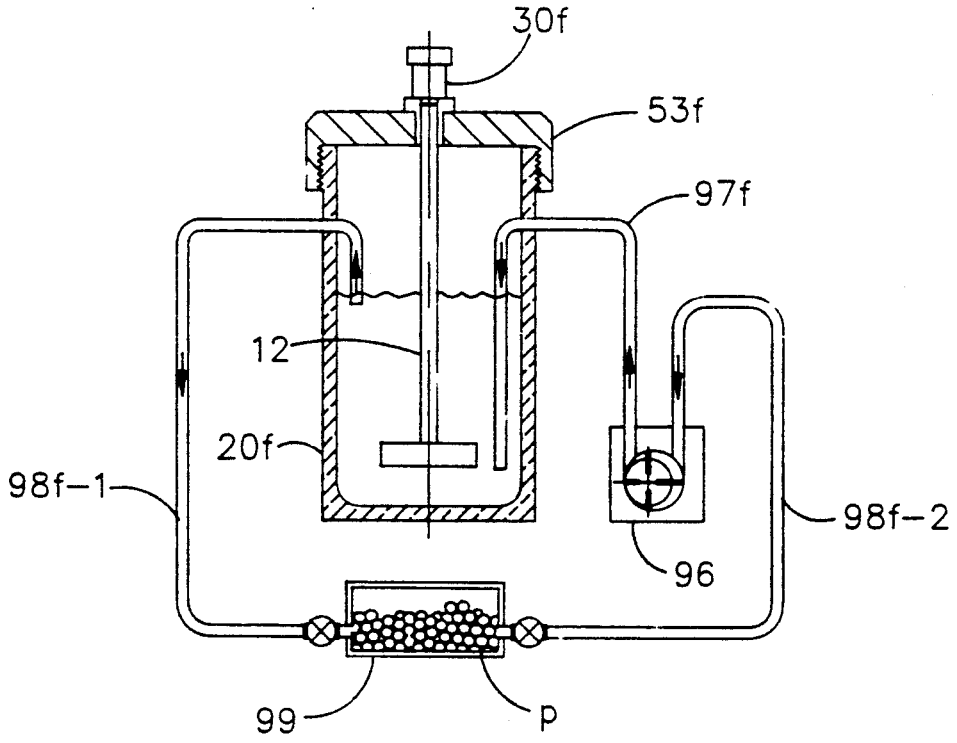

FIGS. 10 and 11 show alternative power mechanisms for moving the razor 12 and contained mineral oil relative to one another, via pump means 96 connected to the vessel by inlet and outlet passages 97*e* and 98*e*. The pump means 96 may be operated by a battery-powered electric motor via an on-off switch (neither being shown) or by a collapsible manually-operated bellows (not shown). The mineral oil would be contained in the vessels 20*e* and 20*f* to level 50*e* and 50*f*, above the cutting blade head end 14. In each embodiment, a cap 53*e* and 53*f* closes the vessel 20*e* and 20*f*, and a razor holding means 30*e* and 30*f* on the cap holds the razor 12 relative thereto substantially centered within the vessel, as in the previous disclosures.

In FIG. 10, pellets P of hygroscopic material, such as calcium chloride ($CaCl_2$) are illustrated as being contained in the mineral oil, on the bottom wall 48*e* of the vessel 20*e* in the region spaced below the blade end 14. In FIG. 11, pellets P of the hygroscopic material are illustrated as being contained in a vessel-like enlargement 99 in the routing passages 97*f* and 98*f*-1 and 98*f*-2 of the mineral oil between the pump 96 and the vessel 20*f*. In either form of apparatus, pump operation would move the mineral oil over the razor blade to coat the blade with the preserving mineral oil; while any water from the razor would then be separated out in this material, during the course of pump operation.

Figure 12:
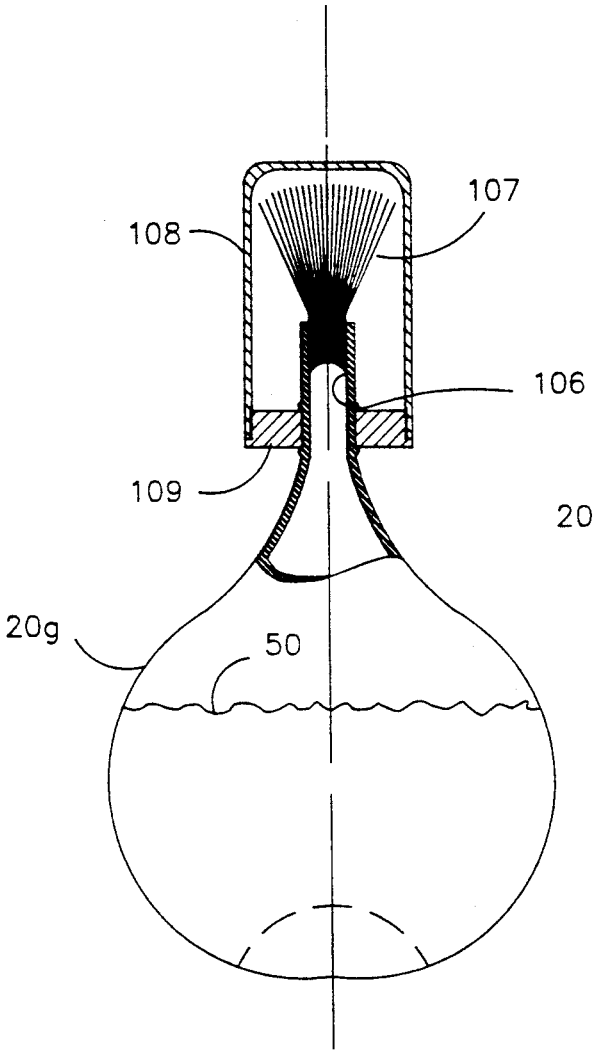
Figure 13:
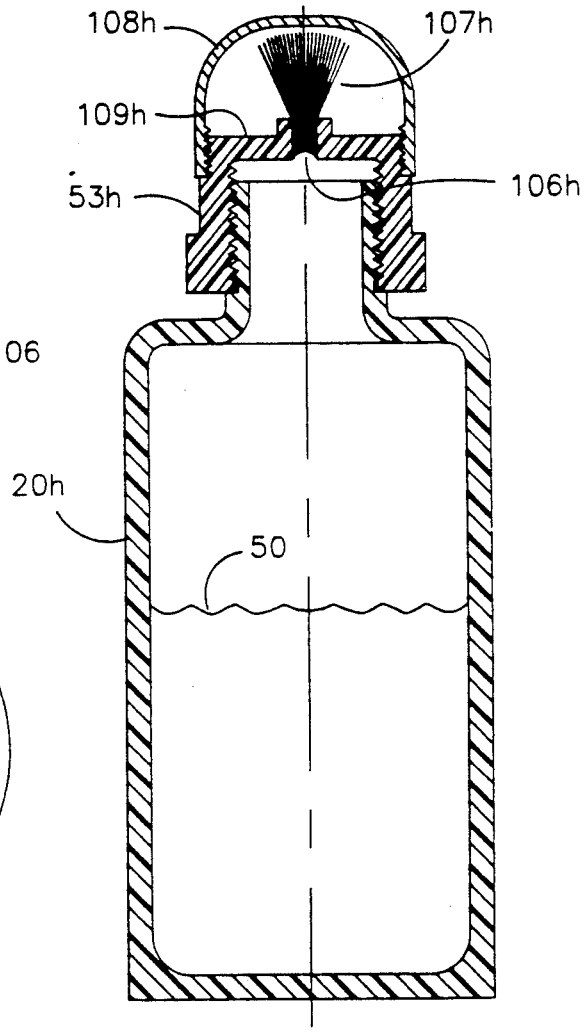

FIGS. 12 and 13 show alternative apparatus for exposing the razor's blade relative to mineral oil contained in portable vessel 20*g* and 20*h*, such as to level 50. In FIG. 12, the vessel 20*g* is comprised as a throw-away squeeze-bulb, having a nozzle opening 106 and brush bristles 107 contained therein. A cap 108 is removably secured to the top vessel wall 109, effective to selectively cover or expose the brush bristles 107. In FIG. 13, a removal cap 53*h* can cooperate with the vessel 20*h*, to allow it to be refilled. The cap has nozzle opening 106*h* and brush bristles 107*h* contained in the opening; and cover 108*h* is removably secured to the cap wall 109*h*, effective to selectively cover or expose the brush bristles 107*h*.

The brush bristles 107 and 107*h* may be of material compatable with the mineral oil, such as of natural bristle materials or of man-made plastic such as high density polyethylene, polytetrafluorethylene, or fluorinated ethlyene propylene.

The portable vessels 20*g* and 20*h* would have great utility for coating the razor blade (not shown) with the mineral oil, at the normal shaving location in one's own bathroom or while on a trip. The mineral oil can be released onto the bristles 107 and 107*h* to wet them by gravity merely by inverting the vessel, while also the vessel 20*g* could be squeezed slightly to force the mineral oil to the bristles, and by capillary action of the bristles too. The bristles would then be stroked along the blade to coat it with the mineral oil. Vessel 20*h* could also have flexible walls to be squeezed to force the mineral oil to the bristles.

It will thus be appreciated that after the razor has been used and water rinsed and the excess water shaken off, the blade would be treated with the mineral oil. This treatment could take place with the razor held in the vessel containing the mineral oil, where the razor could then further be stored in the vessel until its next use; or could be treated in the vessel and then stored in air outside of the mineral oil containing vessel. The mineral oil containing vessel when not in use or during the storage of the razor therein could be covered and relatively isolated from the atmospheric air and its potentially corrosive components. This treatment could moreover take place with the razor held outside of the vessel containing the mineral oil, where the razor would then further be stored in air outside of the vessel.

The operating life of the mineral oil in the containing vessels should be in excess of several months, and with some care, could be even longer.

While specific embodiments of the invention have been illustrated, it is apparent that variations may be made therefrom without departing from the inventive concept. Accordingly, the invention is to be limited only by the scope of the following claims.

What is claimed as my invention is:

1. Apparatus for preserving for storage during nonuse a wet razor having a cutting blade edge, comprising the combination of a portable vessel containing only mineral oil and a hygroscopic material in the mineral oil;

means for exposing the razor blade edge to said mineral oil, and for moving the razor and the mineral oil relative to one another to provide that the blade edge is effectively and throughly coated with the mineral oil;

said means for exposing the razor blade to said mineral oil comprising said vessel having an outlet opening for the mineral oil and flexible brush bristles in and projecting beyond the vessel from said opening, said brush bristles being suited to be moved against and relative to the blade for coating it with the mineral oil;

thereby providing a protective mineral oil coating on the razor to allow razor storage even when exposed to atmospheric air while preserving the razor sharpness from dulling chemical oxidation;

the portable vessel being comprised as a throw-away squeeze-bulb; and a cover cooperating removably with the vessel and operable when in placed on the vessel for enclosing said flexible brush bristles, for when the apparatus in not being used.

2. Apparatus according to claim 1 further including the brush bristles being of material compatable with the mineral oil, of natural bristle materials or of high density polyethlyene, polytetrafluorethlylene, or fluorinated ethylene propylene.

* * * * *